United States Patent [19]

Hockaday et al.

[11] Patent Number: 4,854,219

[45] Date of Patent: Aug. 8, 1989

[54] OPTICAL CONTROL SYSTEM

[75] Inventors: Bruce D. Hockaday, Vernon; Kenneth D. Taylor, South Windsor, both of Conn.

[73] Assignee: United Technologies Corporation, Hartford, Conn.

[21] Appl. No.: 204,661

[22] Filed: Jun. 10, 1988

[51] Int. Cl.[4] ..... F15B 13/16; F15C 1/04

[52] U.S. Cl. ..... 91/367; 91/358 R; 91/368; 137/805

[58] Field of Search ..... 91/358 R, 361, 363 R, 91/367, 368, 388, 389, ; 137/805, 827, 834, 829

[56] References Cited

U.S. PATENT DOCUMENTS

| | | | |
|---|---|---|---|
| 2,939,430 | 6/1960 | Westbury | 91/363 R |
| 3,122,165 | 2/1964 | Horton | 137/834 X |
| 3,780,771 | 12/1973 | Kampe et al. | 137/829 |
| 4,202,247 | 5/1980 | Hunkar et al. | 91/364 |
| 4,256,015 | 3/1981 | Tippetts et al. | 137/829 X |
| 4,512,371 | 4/1985 | Drzewiecki et al. | 137/828 |
| 4,606,375 | 8/1986 | Hockaday | 137/828 |
| 4,610,274 | 9/1986 | Glomb, Jr. et al. | 137/828 |
| 4,643,074 | 2/1987 | Gunda et al. | 91/361 |

*Primary Examiner*—Edward K. Look

*Attorney, Agent, or Firm*—Edward L. Kochey, Jr.

[57] ABSTRACT

An optical actuator position demand signal through optic fiber 14 is focused on one side 32 of optical fluidic interface 16. A second optical signal through optic fiber 56 is attentuated 50 in proportion to actuator 38 position and focused on a second side 34 of the interface 16. Amplified fluidic signals 68, 70 drive the actuator until the demand signal 14 and actual signal 58 are in balance.

5 Claims, 2 Drawing Sheets

OPTICAL CONTROL SYSTEM

TECHNICAL FIELD

The invention relates to optical control systems and in particular to a closed loop actuator control system.

BACKGROUND OF THE INVENTION

Optically controlled actuators have been used as an alternative to electrically control actuators in critical control systems. Control systems containing optically controlled actuators offer a number of advantages for aircraft, industrial and military applications with respect to conventional electrical actuators. These offer a reduced explosion hazard, increased electrical noise immunity and weight savings. They offer better survivability in the presence of electromagnetic interference, electrostatic interference, electromagnetic pulse and high energy particle radiation.

Optically controlled actuators can be either indirectly controlled or directly controlled. An indirectly optically controlled actuator uses an optical communication link to control a conventional actuator but the optical signal is converted to an electrical signal for activation of the actuator. Directly optically controlled actuator uses an optical communication link to directly control the actuator without converting the optical signal to an electrical signal. This is accomplished by the known use of an opto-mechanical interface to convert the optical signal to some mechanical signal such as a differential pressure signal. Such apparatus is known from U.S. Pat. Nos. 4,512,371, 4,606,375, 4,610,274, and 4,722,365. This actual pressure differential is then used to activate the actuator.

For most applications using either type of optically controlled actuator, a position feedback loop is needed in the control system to prevent degradation in system performance due to component and/or environmental changes. This also provides a tight control loop to rapidly move the actuator to the requested position without involving the time lag which would be required to feed the result of the actuated component change back through the remainder of the control system. In previous optically controlled actuator systems this has been accomplished by providing a conventional position transducer attached to the actuator with the output of this transducer fed back to the control system computer. Since the feedback signal be returned to the control computer, which is usually located some distance from the actuator, it is subject to the electrical interferences and other potentially degrading phenomena. This also requires computer time which may be at a premium in controlling an overall complex system.

SUMMARY OF THE INVENTION

An optical control loop is used to establish a desired position of an actuator with the actuator including a fluid driven piston. An optic fluidic interface transducer responds to an optical signal to produce a fluid pressure differential which is amplified and directed to the piston for movement of the actuator.

An optical demand signal is established by the control system of an overall intensity indicative of the desired actuator position. An optical attenuation means is connected to the actuator and varies the attenuation of an optical signal in proportion to the position of said actuator. Depending upon the embodiment this may either be the optical signal which was established as a demand or a second steady state optical signal. The demand optical signal and the attenuated optical signal are summed and the optic fluidic interface transducer is modulated in response to this summation. The summing may be by direct attenuation of the demand signal as in one embodiment or may be accomplished by directing the attenuated signal to one side of a transducer with the demand signal directed to the other side.

DESCRIPTION OF THE PREFERRED EMBODIMENT

Figure 1:
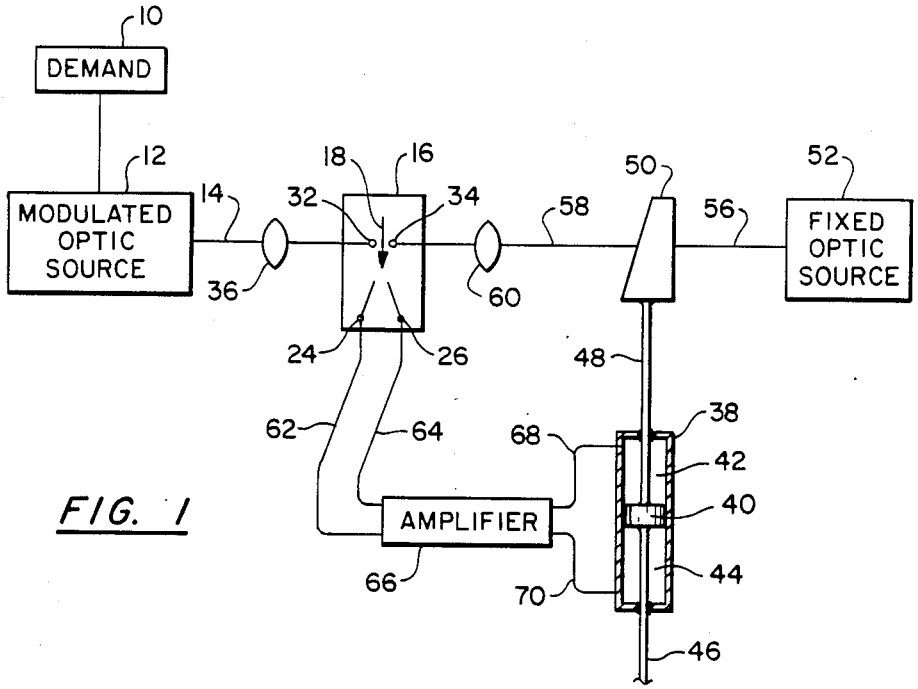
FIG. 1 is a schematic diagram of the preferred optical control loop.

A demand signal 10 is established by an external control system with the demand signal passing to a modulated optic source 12. This demand signal represents a desired actuator position. The source passes an optical signal through optic fiber 14 of an intensity in proportion to the actuator position demand. This signal may be an analog signal of varying intensity or a pulsed signal with the width of the pulses varied to achieve the desired intensity.

An optical fluidic interface transducer 16 is of the type wherein a flow 18 passes through the transducer, flowing in its balanced condition through outlets 20. When the flow through supply nozzle 22 is deflected, varying pressures along with a small flow occurs at outlets 24 and 26. This pressure signal is analog in nature depending on the extent of the deviation.

As known from U.S. Pat. No. 4,610,274 notches 28 and 30 may be supplied in the supply nozzle with focused areas 32 and 34 located at the upstream edge of these notches. When optical energy is focused in these areas the local viscosity of the fluid flowing through the supply nozzle is changed and the flow deviates. The amount of deviation and accordingly the pressure obtained at outlets 24 and 26 is a function of the intensity of the light focused in these focused areas.

The modulated demand signal passing through optic fiber 14 is focused by lens 36 on focus area 32. This causes a deviation in the flow path within the transducer as a function of this demand signal.

An actuator 38 to be controlled includes a piston 40 having a first pressure side 42 and a second pressure side 44. This actuator is connected through connecting rod 46 to the apparatus to be controlled and also has a connection 48 to an optical attenuation means 50. This analog attenuator may be a structure of fiber optic or bulk optic material with varying light passing ability along its length.

A fixed optic source 52 preferably in the form of a laser passes a fixed optical signal through optic fiber 56 directing it through the optical attenuation means 50. The attenuation means attenuates this signal in proportion to the position of actuator 38 so that an attenuated signal passes through optic fiber 58. This attenuated signal is focused by lens 60 on focus area 34 located on the opposite side of the flow supply nozzle from focus area 32.

When the light energy at focus areas 32 and 34 is equal flow 18 will not be deviated and there will be no pressure difference existing at outlets 24 and 26. When a difference in optic energy exists, flow 18 will deviate causing a pressure difference at the outlets, with this pressure difference and a small flow passing through lines 62 and 64.

A plurality of laminar proportional amplifiers receiving the fluid from the interface from lines 62 and 64 form amplifier 66 in a known manner. The amplified signals and flow quantities pass through outlet line 68 and 70 to sides 42 and 44 respectively of piston 40. This pressure differential causes the actuator to move and with it the attenuation means 50. The actuator is therefore moved until the attenuated signal focused on focus area 34 equals that focused on focus area 32. Accordingly, a closed loop optical control loop is achieved with no electrical interfacing required. The system optically operates to provide the demanded actuator position.

This system will operate with a proportional range whenever there is a residual external force operating on the actuator since some pressure differential is required to hold the actuator in that position. This will normally be of no concern since the feedback and the external control system will modify the demand signal 10 to compensate for this. If desired, an appropriate integrated error signal may be incorporated within the optical control loop.

DESCRIPTION OF AN ALTERNATE EMBODIMENT

Figure 2:
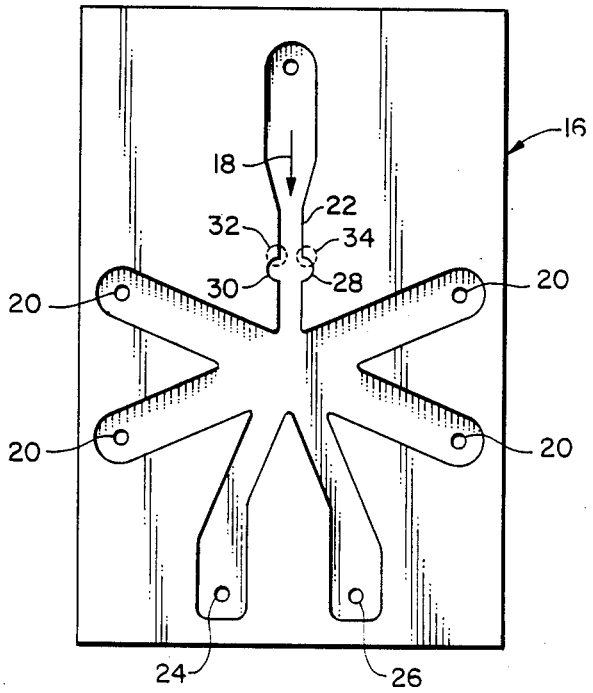
FIG. 2 is an illustration of the optical fluidic interface transducer used in conjunction with the arrangement of FIG. 1.
Figure 3:
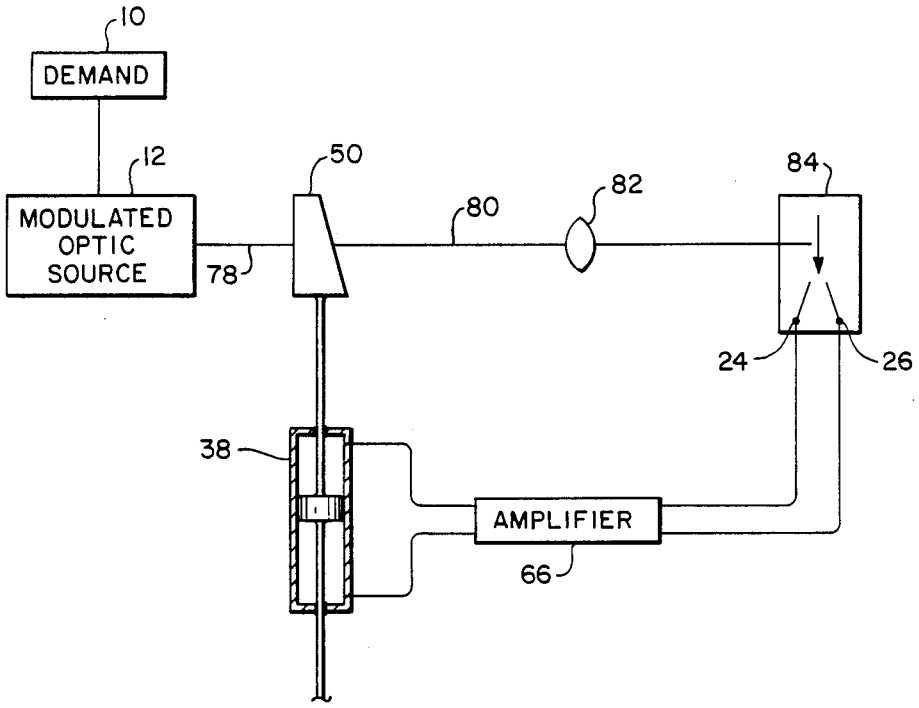
FIG. 3 is a schematic of an alternate optical control loop.

In the alternate embodiment of FIG. 3 the demand signal 10 passes to modulated optic source 12 which sends an optical demand signal through optic fiber 78. Optical attenuating means 50 again connected to actuator 38 by linkage 48 operates to attenuate the demand optical signal in proportion to the position of actuator 38 producing an error signal passing through optic fiber 80. This error signal is focused through lens 82 on an optic fluidic interface transducer 84 which may be a transducer such as shown in FIG. 2 or maybe another transducer which varies the pressure at outlets 24 and 26 in proportion to the light energy impinged thereon.

This transducer is, however, selected to produce a balanced pressure output not at zero energy input, but to produce the balanced output at a preselected energy level which is between the maximum and minimum energy levels available from the optic system. Accordingly, the system operates with the actuator 38 moving in response to the demand signal to achieve the predetermined energy level at transducer 84.

For instance, a system has been produced where the position sensitive attenuator 50 varied the attenuation from 0 decibels to −3 decibels. The optical fluidic interface transducer 84 was selected to produce a null pressure result with an optical power of 5 milliwatts imposed thereon. The optical command signal passing through line 78 varied from 5 to 10 milliwatts. A command signal of 10 milliwatts requested the fully extended position of the actuator where a −3 decibel attenuation occurs. This establishes a 5 milliwatt signal to the transducer.

Sending a 5 milliwatt signal through optic fiber 78 with the still existing −3 decibel attenuation results in a signal of 2.5 milliwatts at the transducer. Accordingly, a pressure unbalance occurs until the actuator 32 reaches the fully retracted condition of a 0 decibel attenuation, at this point 5 milliwatts is achieved at transducer 84.

For a steady state case with a 7 milliwatt command signal the actuator is positioned at an intermediate location where the signal is attenuated by −1.46 decibels thereby resulting at the 5 milliwatt level establishing the appropriate intermediate position of the actuator.

The demand optical signal for either embodiment may be pulsed or steady. A pulsed signal will usually be of a constant frequency with the width of the pulses modulated. The second optical source of the preferred embodiment could be pulsed, but there is no advantage to this and so a steady state signal is used. If an optical fluidic interface transducer responsive to acoustic waves of pulsed input were to be used, the second source would have to be similar and in phase with the first.

Pulsing the demand signal at high frequency would result in an overall smooth action of the signal because of thermal and fluid lag. Lower frequencies may be used to maintain a dither of the actuator to preclude sticking of the actuated component when desired.

The fully optical position feedback loop relieves the control system computer of this function in a manner free from electrical interference.

What is claimed is:

1. An optical control loop for establishing a desired position of an actuator comprising:

a fluid driven piston actuator, said piston having two sides;

an optical fluidic interface transducer;

a plurality of laminar proportional amplifiers receiving fluid from said optical fluidic interface transducer and delivering fluid pressure to each side of said piston;

demand means for establishing an optical demand signal;

an optical attenuation means connected to said actuator and varying an optical signal in attenuation in proportion to the position of said actuator, thereby producing an attenuated signal;

summing means for optically summing said optical demand signal and said attenuated signal; and means for modulating said optical fluidic interface transducer in response to said summed signal.

2. A control loop as in claim 1:

said optical fluidic interface transducer including a supply nozzle and two optical inlets, one inlet on each side of said supply nozzle;

a constant optical source producing a fixed intensity optical signal;

said attenuation means varying said fixed optical signal in proportion to the position of said actuator to produce an actuator position signal; and said summing means comprising said demand signal delivered to one of said optical inlets and said position signal delivered to the other of said optical inlets.

3. An optical control loop as in claim 1:

said summing means comprising said optical attenuation means located to attenuate said demand signal; and said optical fluidic interface transducer selected to produce a null pressure at an optical level between the maximum and minimum values of said attenuated signal.

4. An optical control loop for establishing a desired position of an actuator comprising:

a fluid driven piston actuator, said piston having two sides;

an optical fluidic interface transducer having a supply nozzle and two optical inlets, one of said inlets on each side of said supply nozzle;

a plurality of laminar proportional amplifiers receiving fluid from said optical fluidic interface transducer and delivering fluid pressure to each side of said piston;

an optical source producing a fixed intensity optical signal;

an optical attenuation means connected to said actuator and varying said fixed intensity optical signal in attenuation in proportion to the position of said actuator, thereby producing an attenuated signal;

demand means for establishing an optical demand signal;

means for delivering said demand signal delivered to one of said optical inlets; and means for delivering said attenuated signal to the other of said optical inlets.

5. An optical control loop for establishing a desired position of an actuator comprising:

a fluid driven piston actuator, said piston having two sides;

an optical fluidic interface transducer;

a plurality of laminar proportional amplifiers receiving fluid from said optical fluidic interface transducer and delivering fluid pressure to each side of said piston;

demand means for establishing an optical demand signal;

an optical attenuation means connected to said actuator and varying said optical demand signal in attenuation in proportion to the position of said actuator, thereby producing an attenuated signal;

means for modulating said optical fluidic interface transducer in response to said attenuated signal.

* * * * *